United States Patent [19]

Kern

[11] 4,137,686

[45] Feb. 6, 1979

[54] STEEL RODS WITH HOT ROLLED RIBS FORMED IN A PARTIAL SPIRAL

[75] Inventor: Georg Kern, Munich, Fed. Rep. of Germany

[73] Assignee: Dyckerhoff & Widmann Aktiengesellschaft, Munich, Fed. Rep. of Germany

[21] Appl. No.: 871,332

[22] Filed: Jan. 23, 1978

[30] Foreign Application Priority Data

Feb. 5, 1977 [DE] Fed. Rep. of Germany ..... 2704819

[51] Int. Cl.[2] ..... E04C 3/30; E04C 5/03

[52] U.S. Cl. ..... 52/734; 52/737; 52/740

[58] Field of Search ..... 52/734–740

[56] References Cited

U.S. PATENT DOCUMENTS

| | | | |
|---|---|---|---|
| 1,164,477 | 12/1915 | Tucker | 52/739 |
| 1,288,763 | 12/1918 | Turner | 52/740 |
| 3,335,539 | 8/1967 | Soretz | 52/737 |
| 3,561,185 | 2/1971 | Finsterwalder et al. | 52/737 |
| 3,641,799 | 2/1972 | Wildt | 52/737 |

FOREIGN PATENT DOCUMENTS

| | | | |
|---|---|---|---|
| 2,037,749 | 2/1972 | Fed. Rep. of Germany | 52/737 |
| 2,123,818 | 1/1973 | Fed. Rep. of Germany | 52/737 |

*Primary Examiner*—J. Karl Bell

*Attorney, Agent, or Firm*—Frank L. Durr; Orville N. Greene

[57] ABSTRACT

Steel rods are formed, by hot rolling, with at least three (preferably four) series of ribs extending along the length thereof. The ribs are all formed to extend along a spiral line along the surface of the rods and are so constructed that any cross-cut through the rod must pass through at least one rib. Each of the ribs has end portions which gradually blend into the core of the rod, which core is substantially circular in cross-section. The outer surfaces of the end portions are substantially straight and tangential to the core. Thus, when viewed from the end or in cross-section, the rod has the appearance of a polygon. The polygonal shape of the rod prevents it from rotating after embedding it in concrete when tension is applied to an end thereof. The spiral arrangement permits tension to be applied to the rods by means of screw nuts, etc.

4 Claims, 4 Drawing Figures

FIG. 1
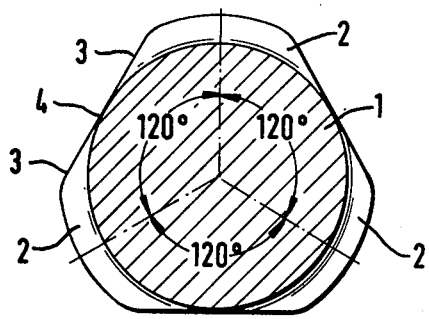
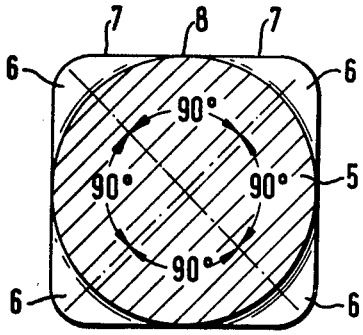
FIG. 2
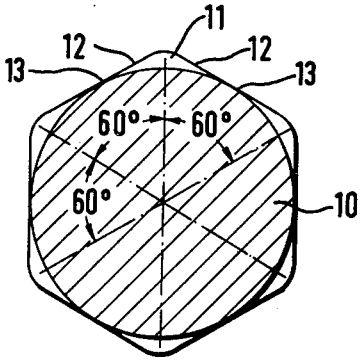
FIG. 4
FIG. 3
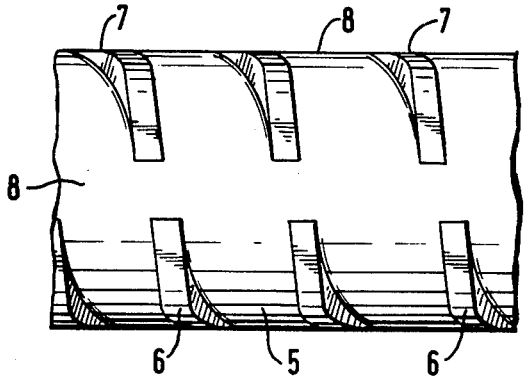

STEEL RODS WITH HOT ROLLED RIBS FORMED IN A PARTIAL SPIRAL

The invention relates to a steel rod, e.g., a concrete reinforcing rod, a tension rod, or the like, with ribs arranged symmetrically to its longitudinal axis, produced by the hot rolling process, which extend along a screw line and form part of a spiral thread.

Suitable steel rods are known as concrete reinforcing rods wherein the ribs are arranged on opposite sides of the rod circumference. They always extend to their full height over about one third of the circumference of the rod, and always extend over nearly half of the transverse plane when their transformation to the smooth surface of the rod is included. (German DT-PS 1784 630 corresponding to U.S. Pat. No. 3,561,185).

This known steel rod is advantageous when employed as a concrete reinforcing rod, because the ribs provide for a good bonding of the rods in concrete, the so-called compound. As a result of the partial spiral arrangement of ribs, such rods can be spliced at the end with the aid of a screw-socket. A steel rod of this type can also, however, be employed as a tensioning rod for stressed concrete, wherein the rod will carry over the prestressing of the concrete structure applied by the tensioning force of a hydraulic press to the end of the rod through a screwable anchoring body.

By rolling of thicker rods down to about 50 mm diameter, or more, it has been shown, however, that the ribs produced in this way arranged on two opposite sides of the rod required proportionately large amounts of material in order to appear in the appropriate size. The longer and the larger the ribs are to be developed, the more difficulty is caused in allowing the material to flow into the ribs forming recesses of the roller process. Besides, a two-sided symmetry in a symmetrically formed and stressed reinforcing element brings with it results which in other respects are not always optimal with regard to the assimilation of the required forces.

This invention is based on the problem, primarily with thick rods, of overcoming the drawbacks with regard to the manufacturing and stressing originating from the two-sided symmetry.

This problem is solved according to the invention by uniformly distributing over the rod circumference more than two, preferably four series of ribs.

Thereby, the transverse plane of the ribs can pass over about tangentially to the normal rod surface. The transverse plane of neighboring ribs run suitably, approximately in one direction and form, as seen in cross-section, the sides of a polygon. Suitably, the transverse plane of the ribs, as seen in cross-section, forming approximately a square.

The fundamental idea of the invention lies in this, that starting from the two-sided symmetrical arrangement of ribs on the known steel rods, to arrange more and smaller ribs distributed in lower spacing from the rod circumference in order to conform the rib arrangement more to the radial symmetry of the rods. Moreover, the especial stress lies in the grouping of four ribs, which are so related to each other, that their transverse section, as seen in the cross-section of the rod, form a square.

A rod form of this type is primarily favorable for large diameter rods, since the material obtained by rolling the rods is better, in particular less material flows into the resultant ribs. Since the individual ribs always lie on a spiral line, each cross-cut through the rod, must pass through at least one rib, so that the material of the ribs, at least to a certain portion, can be added to the cross-section of the rod. Thereby, a more favorable distribution of the dead weight of the ribs relating to carrying rod cross-sectional surface is obtained.

Through the uniform distribution of ribs about the rod circumference, a better condition for initiating the stress of the screwed on anchoring means, is obtained, which means naturally have radial symmetry and in contrast to the partial threads formed by the pairs of ribs, have continuous threads.

With the employment as slack concrete reinforcement rods, the closer approximation of the cross-section to a radial symmetrical cross-section affects the uniting action advantageously. In this way, the individual ribs defining an essentially flat surfaced transverse plane, will also prevent the risk as with reinforcing rods with continuous fully developed threads, that the rod itself by being loaded, will be screwed out of the concrete in which it is embedded.

Further features and advantageous properties of the steel rods made according to the invention will be apparent from the following description of an embodiment thereof shown in the accompanying drawing.

In the drawing:

FIG. 1 is a cross-sectional view through a steel rod with three series of ribs distributed over the circumference.

FIG. 2 is a cross-sectional view of a steel rod with four series of ribs distributed over the circumference.

FIG. 3 is a partial side view of the rod shown in FIG. 2.

FIG. 4 is a cross-sectional view of a steel rod with six series of ribs distributed about the circumference.

FIG. 1 shows a cross-section of a steel rod 1 made according to the invention with an approximate circular core cross-section that is provided with a total of three ribs 2 about its outer circumference, produced by the hot rolling process. The ribs 2 are so constructed that their end surface 3 in the area between each two ribs, pass over into the smooth surface 4 of the rod. The end surface 3 of the ribs 2, form approximately a straight line; they can also be curved somewhat in certain cases in the circumferential direction.

The rod 5 shown in cross-section in FIG. 2, and in side view in FIG. 3, is equipped with four series of ribs 7, wherein each series is spaced about 90° with respect to the next. Also, here the end surfaces 7 of the ribs 7, lie approximately in a straight line and pass normal with respect to the rod surface.

The rod 5, shown in cross-section in FIG. 2, and in side view in FIG. 3, is equipped with four series of ribs 7 wherein each series is spaced about 90° with respect to the next. Also, here the end surfaces 7 of the ribs 6 lie approximately in a straight line and pass normal with respect to the rod surface.

A further modification is shown in FIG. 4. Here, the reinforcing rod 10 has six series of ribs 11 spaced about 60° from each other. The transverse planes 12 of the ribs 11 form hexagonal sides and pass, similarly to the transverse sections of FIG. 1 and 2, normally to the rod surface 13.

The steel rod of the invention is not only useful for concrete reinforcing or tensioning rods, but also for many other purposes in which a highly resistable, coarse thread, in combination with a tensioning force, is required as, for example, for earth or rock anchors, sheathing anchors in concrete construction, dead-end ties of different kinds, and the like.

I claim:

1. Steel rods for reinforcing rods, tensioning rods and the like, of the type which comprise a core substantially circular in cross-section and contain ribs formed by the hot rolling process, which are symmetrically arranged with respect to the longitudinal axis of the rod and which extend along a spiral line so as to form part of a screw thread, which comprise at least three to six series of said ribs spaced from each other and distributed over the circumference of the core of the rod, said rods being of such construction and number per unit length that any cross cut through the rod must pass through at least one rib.

2. Steel rods as claimed in claim 1, comprising four series of said ribs.

3. Steel rods as claimed in claim 1, wherein each of said ribs has end surfaces which gradually extend down to the core of the rod so that the outer surface of the ends of said ribs are approximately tangential to said core.

4. Steel rods a claimed in claim 1, wherein each of the ribs has end surfaces which gradually extend down to the core of the rod, the outer surfaces of said ends of the ribs being approximately straight and extending tangentially to the core, whereupon in cross-section, the rods discloses the outline of a polygon.

* * * * *